United States Patent [19]

Gustafson

[11] 4,384,710

[45] May 24, 1983

[54] SHEET FEEDER AND TRANSFER APPARATUS

[75] Inventor: Arthur L. Gustafson, St. Charles, Ill.

[73] Assignee: Alloyd Co., Inc., DeKalb, Ill.

[21] Appl. No.: 265,919

[22] Filed: May 21, 1981

[51] Int. Cl.[3] ..... B65H 3/08; B65H 3/48; B65H 3/56

[52] U.S. Cl. ..... 271/9; 271/20; 271/30 R; 271/98; 271/104; 271/105; 271/107; 414/116

[58] Field of Search ..... 271/9, 20, 24, 25, 30 R, 271/31, 97, 98, 104, 105, 107, 169; 414/116, 118, 121

[56] References Cited

U.S. PATENT DOCUMENTS

| | | | |
|---|---|---|---|
| 1,498,965 | 6/1924 | Henderson | 271/98 |
| 1,864,008 | 6/1932 | Wright et al. | 53/488 |
| 2,173,803 | 9/1939 | Gammeter | 53/487 |
| 2,476,577 | 7/1949 | Backhouse | 271/98 |
| 2,595,546 | 5/1952 | Sampson | 271/97 |
| 2,827,288 | 3/1958 | Geisler | 271/24 |
| 2,848,227 | 8/1958 | Gulick | 271/98 X |
| 2,914,894 | 12/1959 | Hansen | 53/488 |
| 3,398,841 | 8/1968 | Mohr | 414/114 |
| 3,552,741 | 1/1971 | Staines | 271/98 |
| 3,596,900 | 8/1971 | Sundin | 271/98 |
| 3,810,345 | 5/1974 | Lemmond et al. | 53/306 |
| 3,822,024 | 7/1974 | Endter et al. | 271/20 |
| 3,891,205 | 6/1975 | Sunahara et al. | 271/98 |
| 3,913,300 | 10/1975 | Benzing | 53/287 |
| 4,065,909 | 1/1978 | Mueller | 53/420 |

*Primary Examiner*—Bruce H. Stoner, Jr.

*Assistant Examiner*—David F. Hubbuch

*Attorney, Agent, or Firm*—Neuman, Williams, Anderson & Olson

[57] ABSTRACT

An apparatus is provided for feeding and transferring the top sheet from a stack of sheets. The apparatus includes a frame; a first member mounted on said frame for controlled movement in a vertical direction from a predetermined substantially horizontal first position; and a stationary second member mounted on the frame at a predetermined elevation above the first member when at the first position. The first member subtends and supports a stack of sheets. The second member is provided with an opening which is in vertical alignment with the supported stack of sheets. Opposed first perimetric segments of the opening are provided with upwardly convergent surfaces which frictionally engage corresponding peripheral portions of the top and adjacent sheets of the stack, when the first member has moved the stack upwardly a predetermined amount. The frictional engagement causes the top sheet to be upwardly distorted within the opening. Air-circulating means are positioned along perimetric segments of the second member opening and cause air to flow across the underside of the distorted top sheet to effect partial separation of the top sheet from the adjacent sheets of the stack. A third transfer member is provided which is disposed above the second member and moves towards and away from the opening thereof and engages the distorted top sheet and draws same completely through the opening and away from the remaining sheets of the stack.

13 Claims, 14 Drawing Figures

FIG. 4
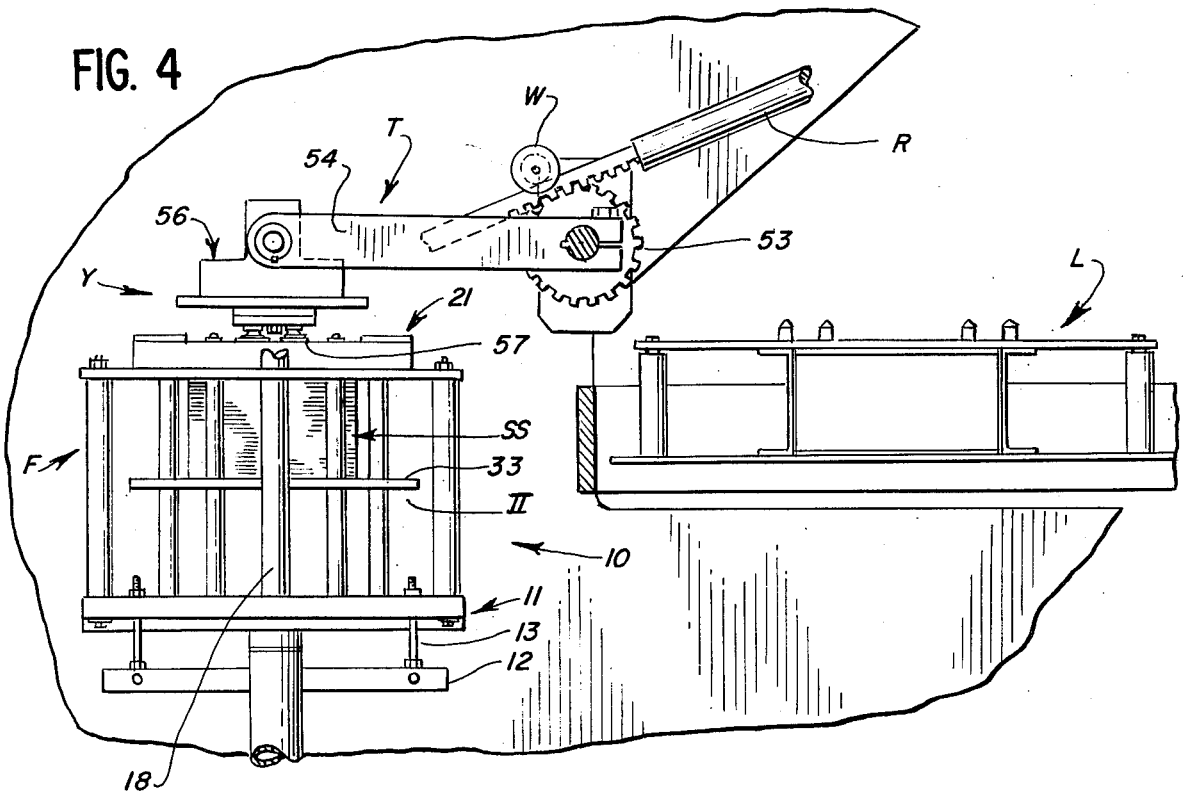
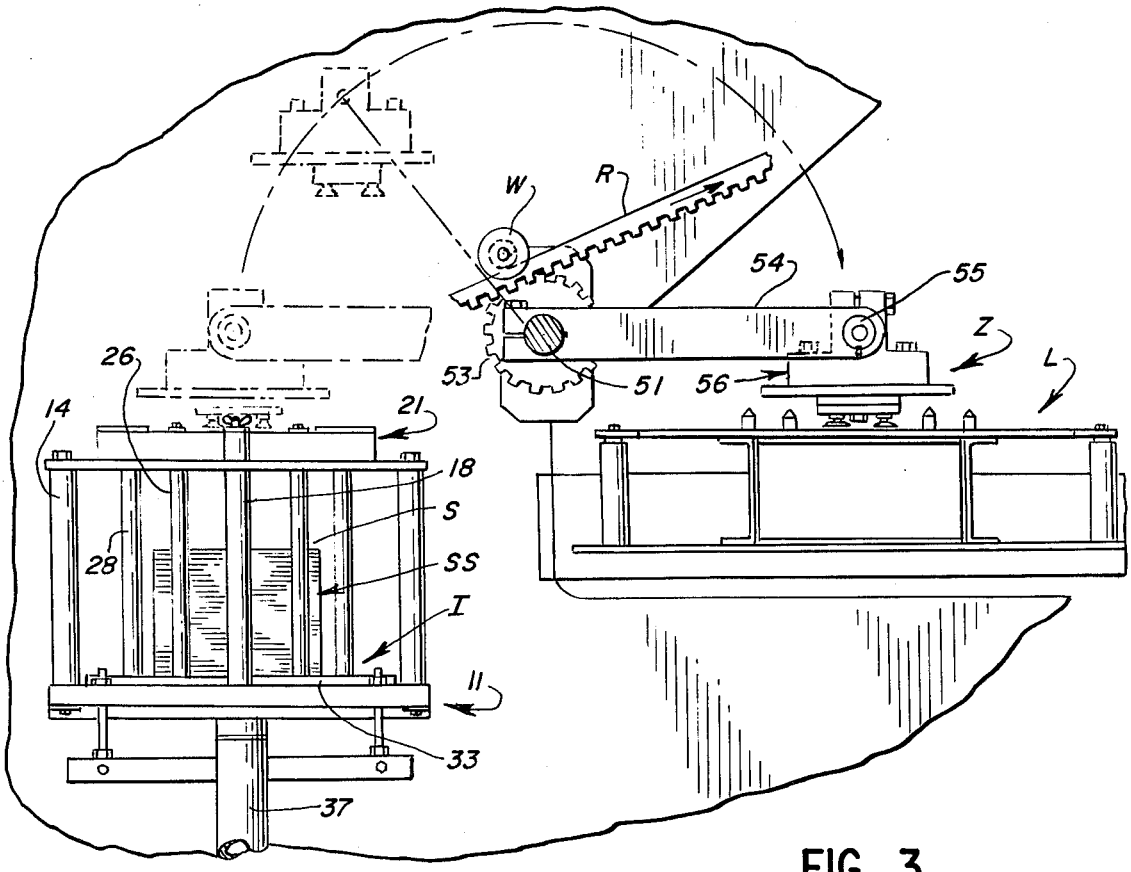
FIG. 3

FIG. 8
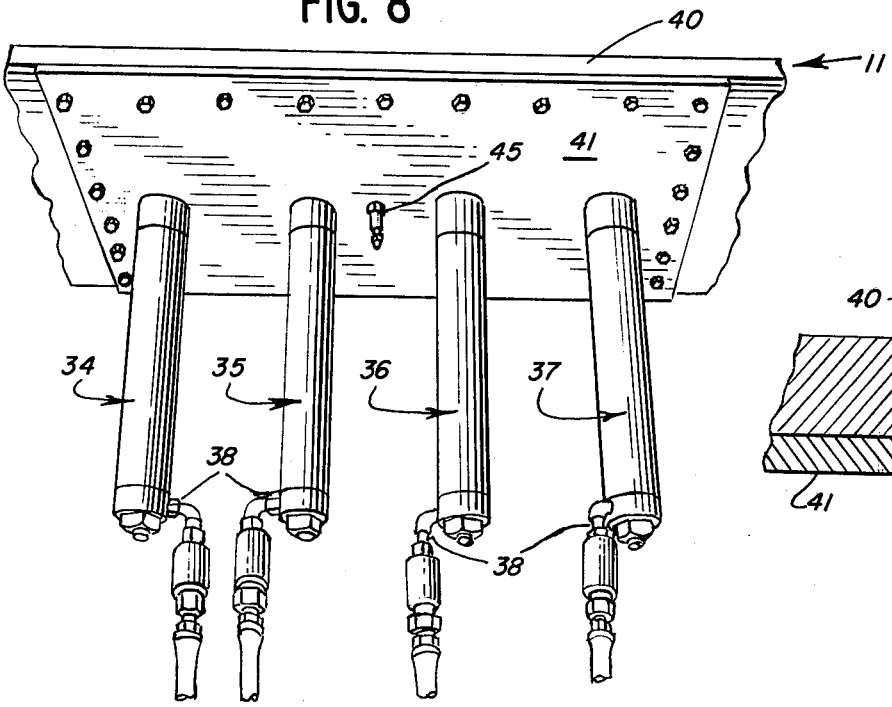
FIG. 10
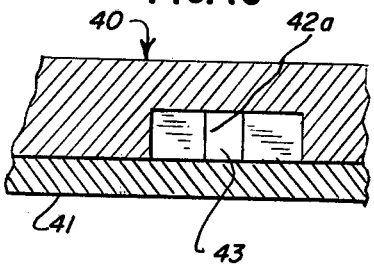
FIG. 11
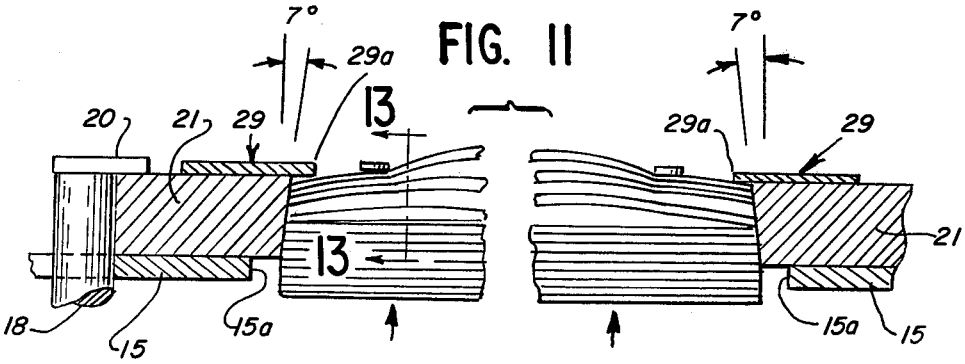
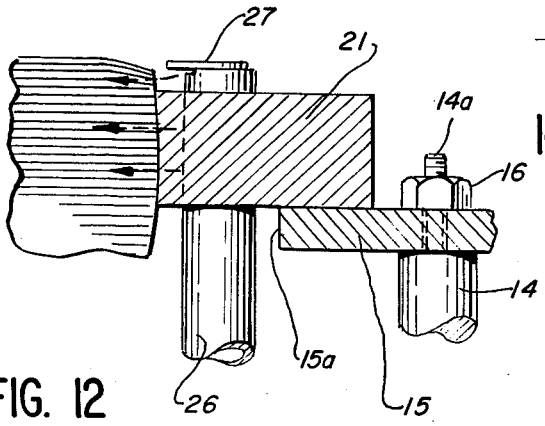
FIG. 12
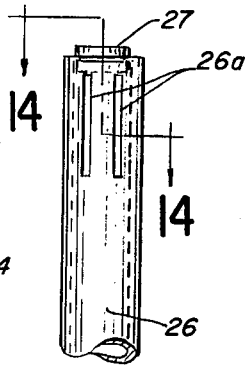
FIG. 13
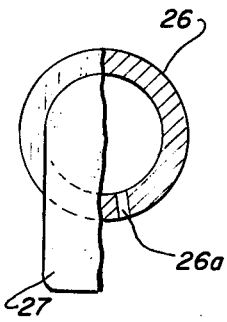
FIG. 14

SHEET FEEDER AND TRANSFER APPARATUS

BACKGROUND OF THE INVENTION

Various sheet feeder and transfer apparatus have heretofore been provided; however, because of certain design characteristics they are beset with one or more of the following shortcomings: (a) the apparatus is of costly, complex construction and is highly susceptible to malfunction; (b) the apparatus is incapable of readily accommodating sheets which vary in size and shape over a wide range; (c) the operating speed of the apparatus is such that it is awkward and difficult to integrate the apparatus in a high-speed packaging system; and (d) the apparatus is difficult to service and maintain.

SUMMARY OF THE INVENTION

Thus, it is an object of the invention to provide an apparatus which avoids the aforementioned shortcomings.

It is a further object of the invention to provide an apparatus which is of simple, compact construction and is capable of simultaneously handling a variety of sheets.

It is a still further object to provide an apparatus which does not cause permanent deformation or defacement of the sheet being transferred.

Further and additional objects will appear from the description, accompanying drawings, and appended claims.

In accordance with one embodiment of the invention, an apparatus of the type described is provided which includes a frame; a first member mounted on the frame for controlled movement in a vertical direction from a predetermined first position; and a second member fixedly mounted on the frame at a predetermined elevation with respect to the first member when the latter is at the first position. The first member subtends and supports a stack of sheets. The second member is provided with an opening which is in vertical alignment with the stack of sheets, when the latter is supported by the first member. Opposed perimetric segments of the opening are provided with upwardly convergent surfaces which frictionally engage corresponding peripheral portions of the top and adjacent sheets of the stack when the latter is moved upwardly a predetermined amount by the first member. The convergent surfaces prevent the sheets from passing unaided through the second member opening. When the top sheet is frictionally engaged by the convergent surfaces of the opening, the portion of the top sheet intermediate the convergent surfaces is distorted upwardly into the opening of the second member because of the upwardly directed force exerted on the stack of sheets by the first member. Air-circulating means is positioned adjacent the second member opening and is adapted to cause air to flow across the underside of the distorted top sheet and the sheets adjacent thereto and effect partial separation of the top sheet from the adjacent sheets. A third member is provided which is mounted above the second member and is movable towards and away from the second member opening. The third member is adapted to engage the distorted portion of the top sheet and draw the latter completely through the opening and away from the remaining sheets of the stack and transfer same to a remote location wherein the sheet is deposited.

DESCRIPTION OF THE INVENTION

For a more complete understanding of the invention reference is made to the drawings wherein:

FIG. 3 is an enlarged fragmentary sectional view of the apparatus taken along line 3—3 of FIG. 1 and showing the loaded pusher plates in their first positions and the sheet transfer section of the apparatus in a mode for discharging a sheet at a remote location.

FIG. 4 is like FIG. 3, but showing the loaded pusher plates in a raised position and the sheet transfer section in a second mode for engaging the distorted top sheets and removing same from the stacks of sheets positioned on the pusher plates.

Figure 5:
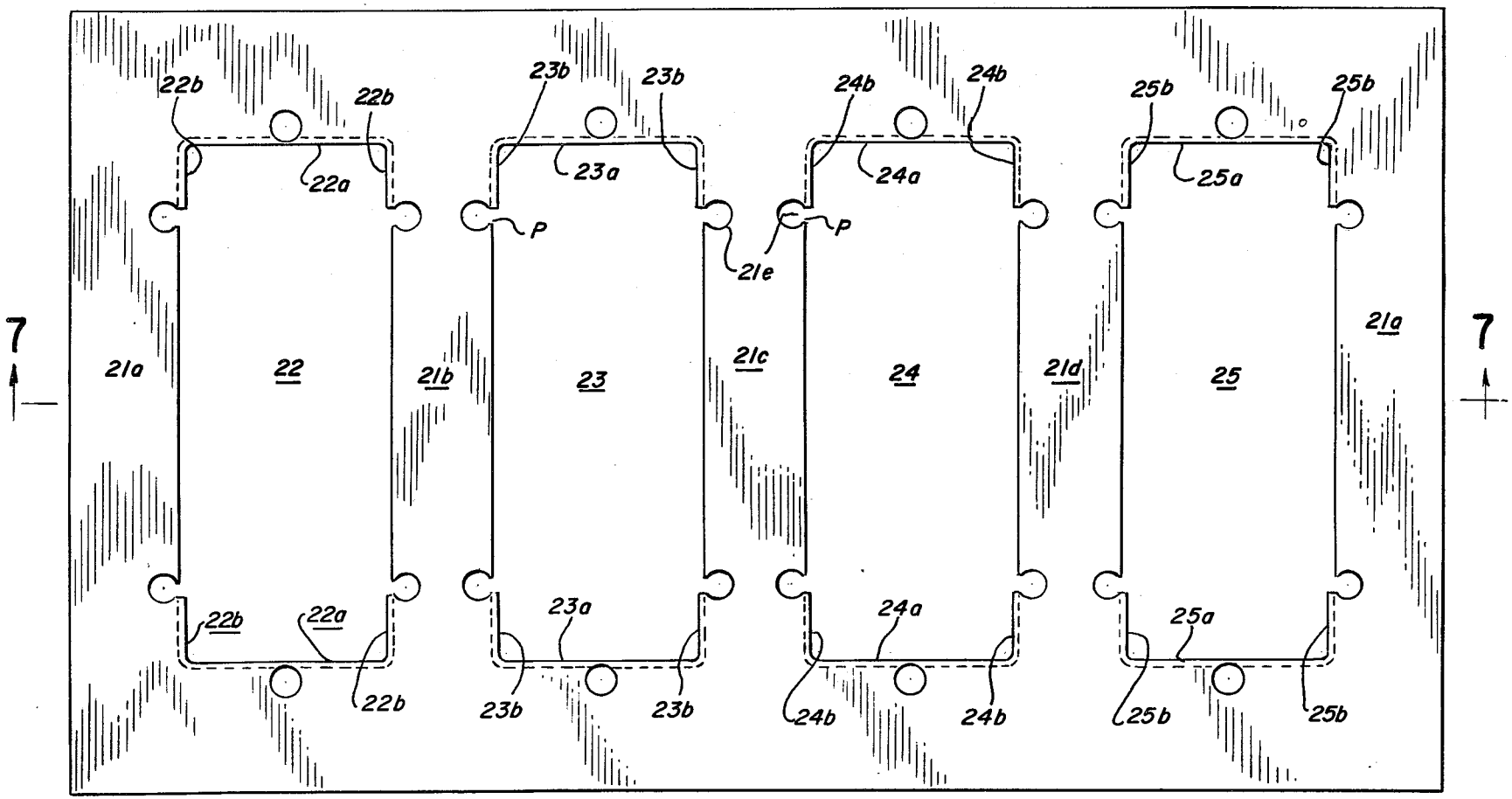
FIG. 5 is a top view of an adaptor plate per se which forms a component of the second member shown in FIG. 1.
Figure 6:
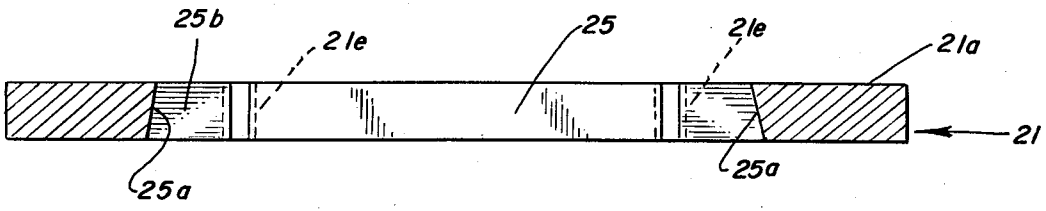
Figure 7:
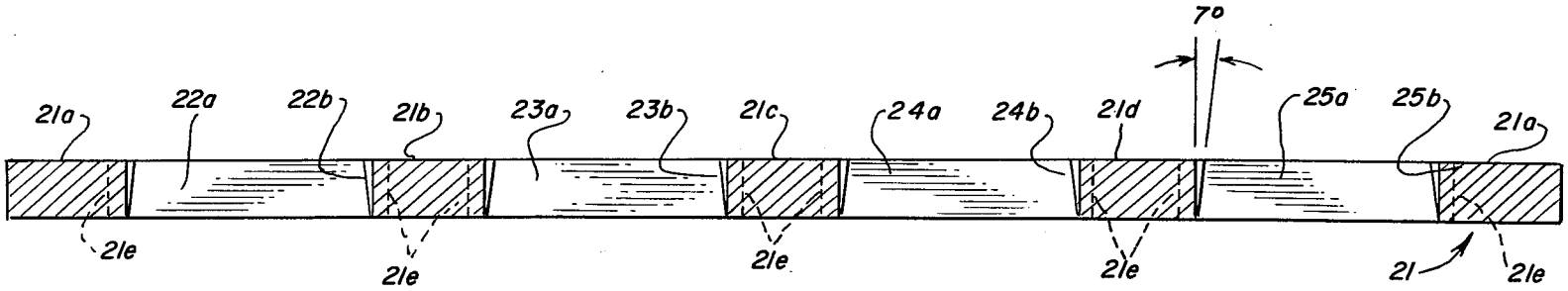

FIGS. 6 and 7 are enlarged sectional views taken along lines 6—6 and 7—7, respectively of FIG. 5.

Figure 1:
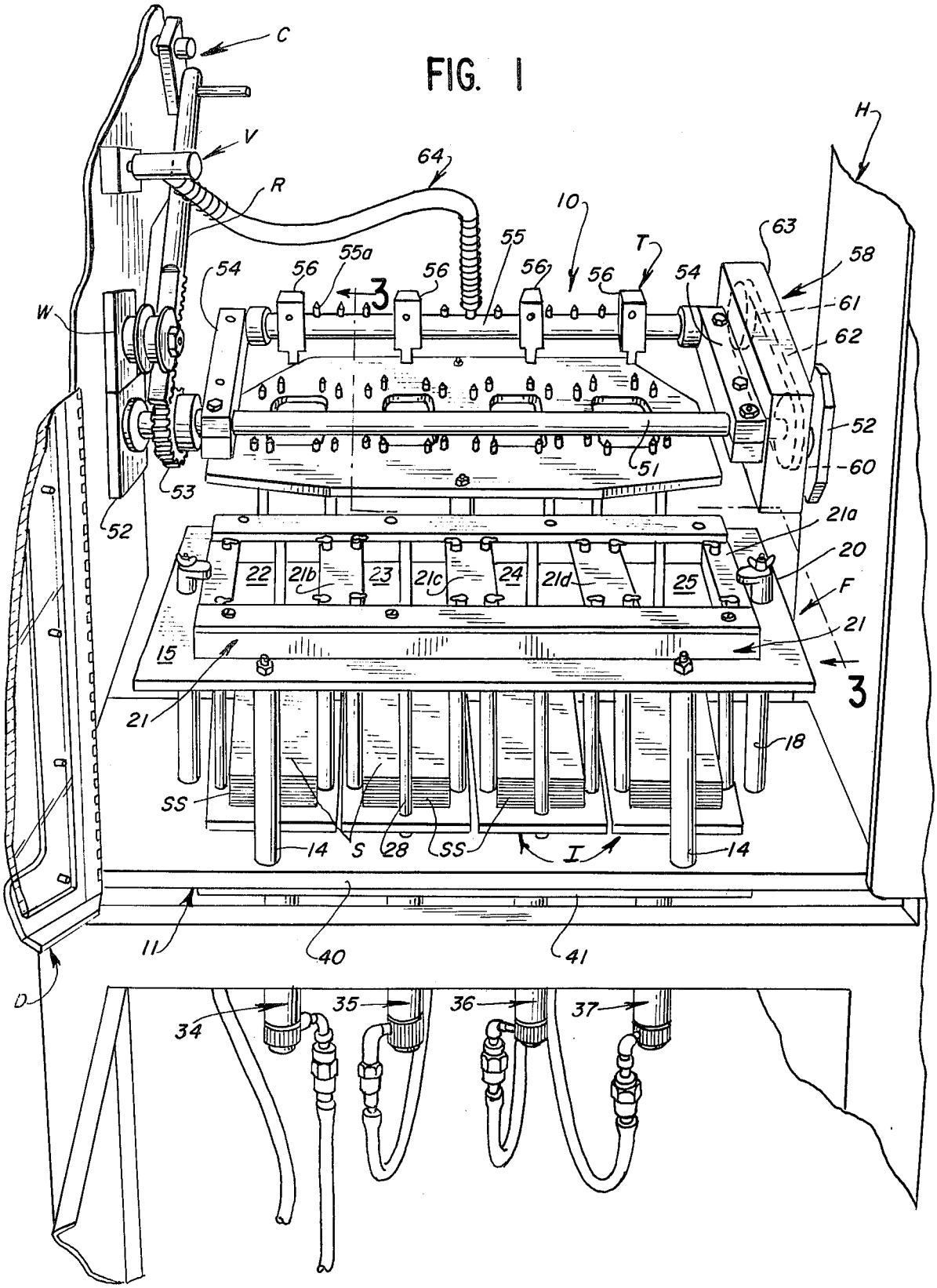
FIG. 1 is a fragmentary perspective top view of one form of the improved sheet feed and transfer apparatus and showing the first members thereof (hereafter referred to as pusher plates) loaded with stacks of sheets and disposed at their first positions.

FIG. 8 is a fragmentary perspective view of the base unit forming a part of the feeder section shown in FIG. 1.

Figure 9:
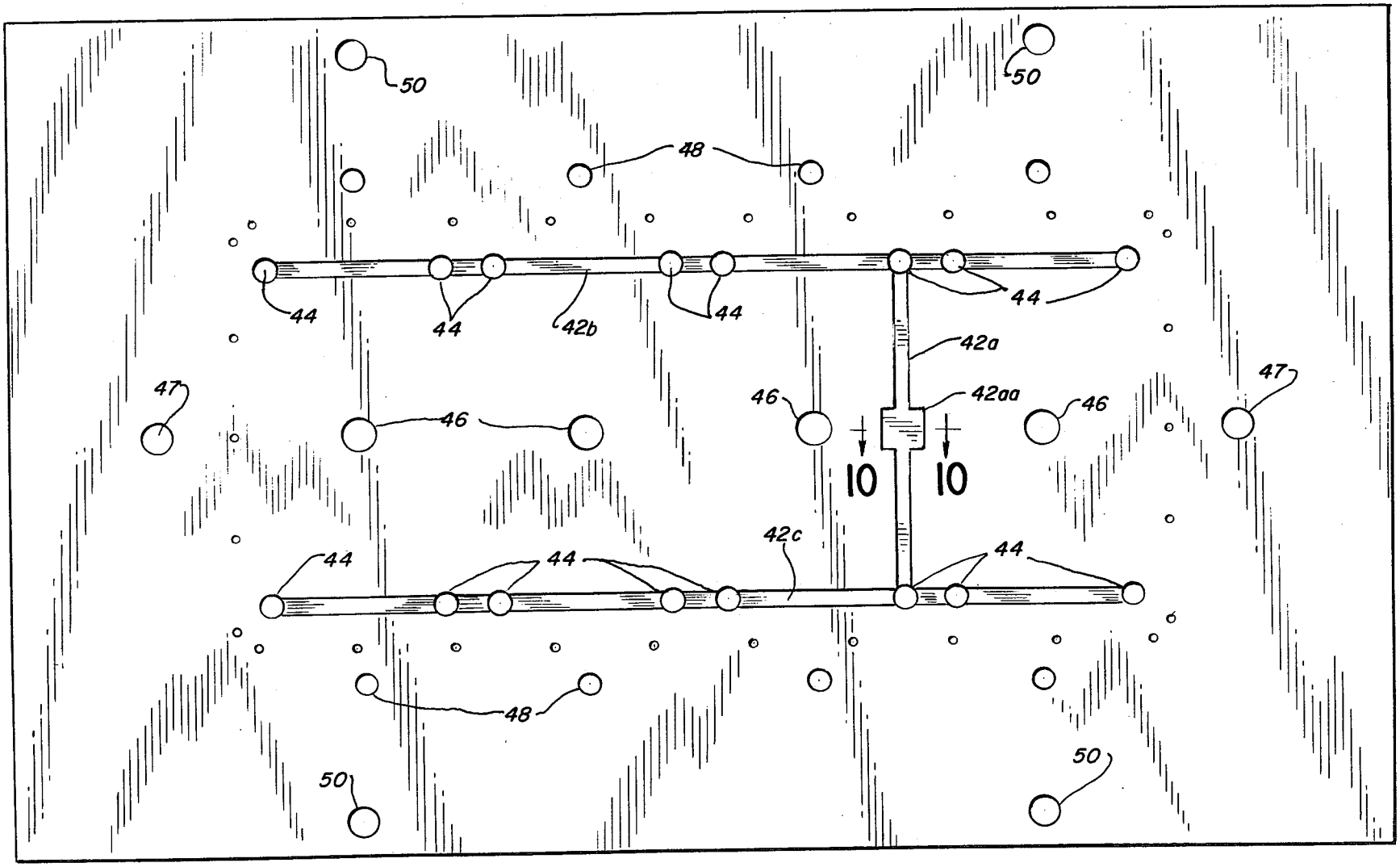

FIG. 9 is a bottom view of a manifold plate member which is a component of the assembly shown in FIG. 8.

FIG. 10 is an enlarged fragmentary sectional view taken along line 10—10 of FIG. 9, but showing a second plate member secured thereto.

Figure 2:
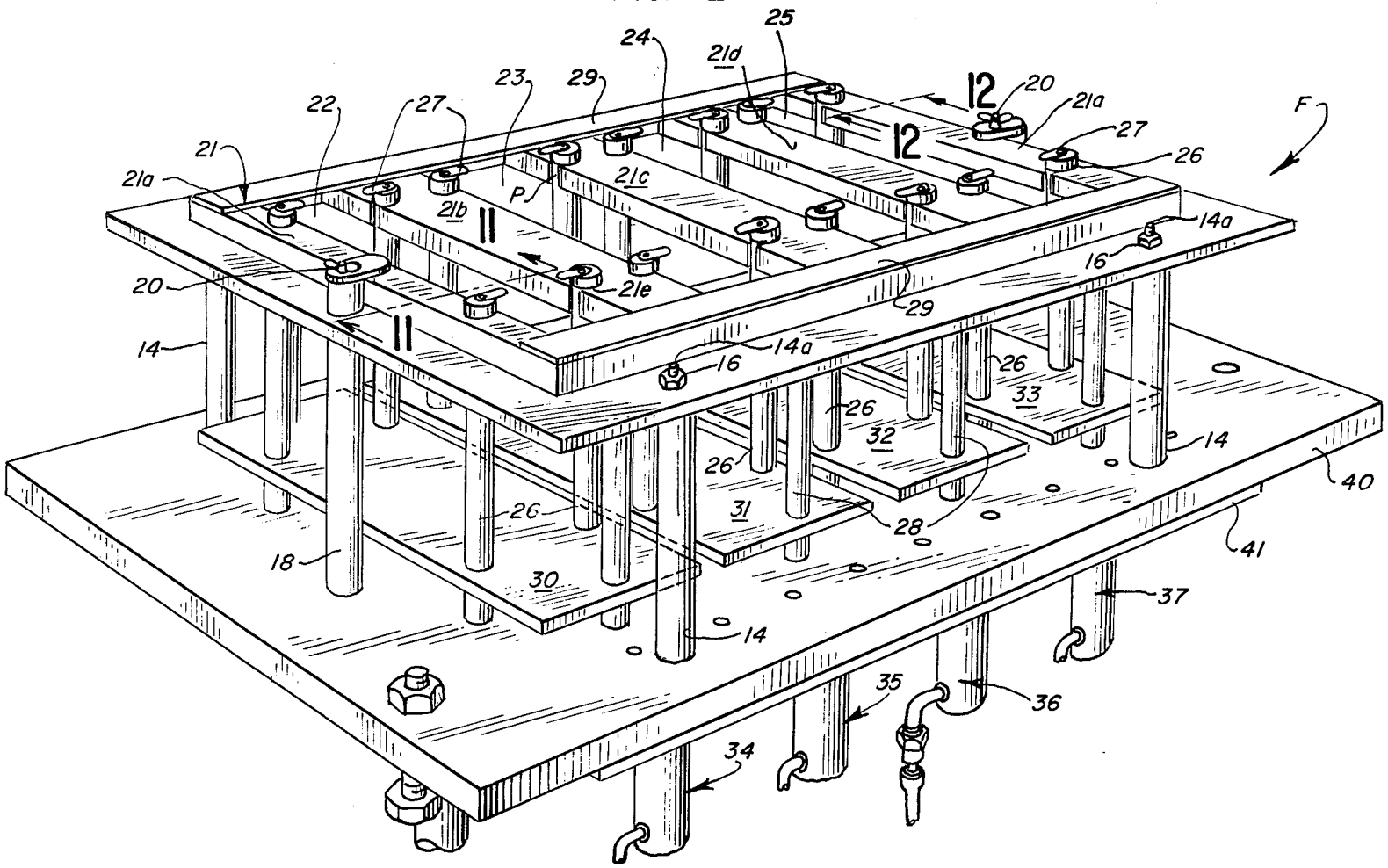
FIG. 2 is an enlarged fragmentary perspective top view of the sheet feed section of the apparatus shown in FIG. 1.

FIG. 11 is an enlarged fragmentary longitudinal sectional view taken along line 11—11 of FIG. 2 and showing a stack of sheets in a raised position with respect to one opening in the adaptor plate and with the top sheet thereof and the sheets adjacent thereto in an upwardly distorted condition.

FIG. 12 is an enlarged fragmentary sectional view taken along line 12—12 of FIG. 2 and with a stack of sheets in a raised position with respect to the adaptor plate.

FIG. 13 is an enlarged fragmentary elevational view of one of the tubular elements embodied in the apparatus of FIG. 2 for effecting air circulation between the distorted sheets of a stack.

FIG. 14 is an enlarged sectional view taken along line 14—14 of FIG. 13.

Referring now to the drawings and more particularly to FIGS. 1–4, one form of the improved sheet feeder and transfer apparatus 10 is shown. The apparatus includes a feeder section F and a transfer section T, both of which may be disposed within an upright housing H. The housing is provided with suitable doors D or removable wall panels to provide ready access to the interior of the housing for loading or adjusting the apparatus, when required.

The feeder section F comprises a horizontally disposed base unit 11 which is supported by suitable bracket members 12 carried by the housing. The level of the base unit 11 may be adjusted by suitable adjusting bolts 13, see FIGS. 3 and 4. Projecting vertically upwardly from the base unit 11 are a plurality of symmetrically arranged spacer posts 14. Fixedly secured to the upper ends of the posts 14 is a horizontally disposed support plate 15 which is in registered substantially parallel relation with the base unit 11. Suitable hold-down nuts 16 are provided which engage threaded ends 14*a* of the spacer posts extending through openings formed in the peripheral portion of the plate. Plate 15 is provided with an enlarged central opening 15*a*, see FIGS. 11 and 12, the function of which will be described more fully hereinafter.

Also extending upwardly from base unit 11 is a pair of horizontally spaced posts 18 which extend through suitable openings formed in the peripheral portion of plate 15. Adjustably carried at the upper end of each post 18 is a clamp piece 20. The clamp pieces coact with one another and with support plate 15 to hold in place on the upper surface thereof an adaptor plate 21. In the illustrated embodiment, adaptor plate 21 is provided with four elongated coextensive openings 22, 23, 24, and 25 which are arranged in horizontally spaced, substantially parallel relation. The openings 22–25 may be of like configuration as shown and such configuration will depend upon the shape of the sheets S to be transferred by the apparatus. The number of openings provided in the adaptor plate will also depend upon the number of sheets to be simultaneously transferred for each stroke of the transfer section T, as will be described more fully hereinafter.

The marginal portion 21*a* of the adaptor plate 21 extends beyond the opening 15*a* of plate 15 and overlies the upper surface of the plate 15 circumjacent the opening 15*a*, see FIGS. 11 and 12. The openings 22–25 of plate 21 are separated from one another by elongated narrow segments 21*b*, 21*c*, 21*d*, see FIG. 2. The elongated segments and the corresponding segments of the marginal portion 21*a* of the adaptor plate 21 are provided with slotted openings 21*e* which are adapted to receive the upper ends of upwardly extending tubular members 26. The members are fixedly mounted on the base unit 11. If desired, a tonguelike deflector piece 27 may be attached to the upper end of each tubular member 26.

Formed in the upper end of each member 26 is one, or more, elongated slots 26*a*, see FIGS. 13, 14, through which air under pressure is caused to be discharged. The spacing between the slots 26*a* may vary as desired. In order not to obstruct the air flow through the slots 26*a*, corresponding perimetric portions of the openings 21*e* are left open so as to provide air passageways P between the openings 21*e* and the adjacent opening 22, 23, 24, 25 formed in the adaptor plate 21.

The tubular members 26 and additional upright posts 28 mounted on the base unit 11 serve as guides for pusher plates 30, 31, 32, 33, which are mounted for vertical movement between the base unit 11 and the elevated support plate 15. There is one pusher plate for each opening 22, 23, 24, 25 formed in the adaptor plate 21 and each pusher plate is adapted to accommodate a stack of sheets SS. The number of sheets comprising a stack will vary according to thickness of each sheet and the spacing between the underside of the adaptor plate 21 and the upper surface of the pusher plate when the latter is in a first position I (i.e., the pusher plate is fully retracted relative to the adaptor plate), see FIG. 3.

Upward movement of each pusher plate is effected by a corresponding piston-cylinder unit 34, 35, 36, 37, see FIG. 8. Each piston-cylinder unit is mounted on the underside of the base unit 11, as seen more clearly in FIG. 8. Provided at the lower end of each unit is a two-way connection 38 for, (a) introducing compressing air into the unit to effect upward movement of the piston thereof and cause the corresponding pusher plate to move upwardly; and (b) releasing the pressure within the cylinder and allow the piston to retract into the cylinder and the corresponding pusher plate to return to position I. Each pusher plate 30–33 is movable independently of the other in a vertical direction. The air pressure exerted on the pusher plate piston should be sufficient to cause the uppermost sheet S of the stack SS to be disposed within the corresponding opening formed in the adaptor plate, but not to pass unaided entirely through the opening.

The opposing end walls 22*a*, 23*a*, 24*a*, 25*a* defining each opening 22, 23, 24, 25 of the adaptor plate 21 are provided with upwardly convergent surfaces, see FIG. 6. Likewise, corresponding portions 22*b*, 23*b*, 24*b*, and 25*b* of the side walls defining the aforesaid adaptor plate openings are also provided with upwardly convergent surfaces. When the pusher plates 30–33 are raised so as to assume a second position II, see FIG. 4, peripheral portions of the top sheets and the sheets adjacent thereto will frictionally engage the upwardly convergent surfaces 22*a–b*, 23*a–b*, 24*a–b*, 25*a–b* of the adaptor plate openings and cause the central portions of the top and adjacent sheets to be distorted upwardly, see FIG. 11. The angularity of the convergent surfaces may be approximately 7° from the vertical. The spacing between the upper limits of the convergent surfaces of the opening end walls, and the corresponding portions of the opening side walls, must be less than the corresponding dimension of the sheets so that the desired distortion of the sheets will result when upward pressure is exerted on each stack by the pusher plate. The air pressure supplied to the piston-cylinder assemblies 34–37 may be preset so as to attain the desired upward pressure exerted on the stacks by the respective pusher plates. In addition to the convergent surfaces, the frictional resistance encountered by the peripheral edges of the top sheets may be increased by utilizing retainer bars 29 which are mounted on the exposed surface of the adaptor plate. As seen in FIG. 11, the bars 29 are positioned so that one elongated edge 29*a* thereof projects slightly into the adjacent opening.

The base unit 11 is formed of an upper manifold plate member 40 (FIG. 9) and a lower plate member 41 which are secured to one another in face-to-face relation, see FIGS. 2 and 8. As will be observed in FIG. 9, the underside or concealed surface of plate member 40 is provided with a plurality of grooves 42*a*, 42*b*, 42*c* which interconnect with one another and coact with plate member 41 to form a narrow internal passageway 43. The passageway communicates with a plurality of openings 44, each of which is adapted to have affixed thereto the lower end of a tubular member 26.

Groove 42*a* is provided with an enlarged section 42*aa* which is aligned with an air inlet connection 45, see FIG. 8, carried by plate member 41. A common source of compressed air, not shown, is provided for supplying compressed air to connections 38 and 45.

Openings 46 are also formed in the manifold plate member 40 and are aligned with corresponding openings formed in lower plate member 41. The aligned openings are sized to slidably accommodate the piston of the piston-cylinder units 34–37. The upper end of each piston is secured to the underside of a pusher plate 30–33.

Plate member 40 is also provided with openings 47 and 48 for fixedly accommodating the lower ends of guide posts 18 and 28, respectively. In a similar manner, the lower ends of the spacer posts 14 are fixedly mounted within openings 50 formed in the peripheral portion of plate member 40.

The transfer section T of the improved apparatus 10, as seen more clearly in FIGS. 1, 3, and 4, includes an elongated shaft 51 supported at opposite ends by suitable bearings 52 carried on the housing H. A driven gear 53 is keyed to one end portion of shaft 51. Extending radially in the same direction from shaft 51 are axially spaced arms 54. The outer ends of the arms are interconnected by a tubular section 55, which is adapted to turn in a controlled manner about its longitudinal axis, as will be described more fully hereinafter. Adjustably mounted on section 55 are a plurality of suction heads 56. The number of heads 56 mounted on section 55 will correspond with the number of openings 22–25 formed in the adaptor plate 21. The relative position of each head 56 on the tubular section 55 is such that the head will be properly located with respect to a corresponding opening formed in the adaptor plate 21 when the transfer section is disposed in its sheet pick-up mode Y, as seen more clearly in FIG. 4. Each suction head 56 may be of conventional construction and includes one or more depending suction cups 57 which will engage the exposed surface of the upwardly distorted top sheet S of the stack and cause the sheet to adhere thereto when a vacuum is drawn on the cups.

The end portion of shaft 51, which is opposite the driven end thereof, is provided with an auxiliary drive means 58 for effecting controlled turning of the tubular section 55 as the transfer section T moves between its pick-up mode Y (FIG. 4) and its discharge mode Z (FIG. 3). By reason of the controlled turning of the section 55, the suction heads 56, as seen in phantom lines in FIG. 3, will maintain the transferred sheet in a substantially horizontal or predetermined position while being transferred and thus, facilitate spotting the transferred sheet at a precise location L when it is released from the suction head. Where the released sheet functions as a cover for a traylike receptacle, properly orienting the sheet onto the open top of the receptacle at the location L becomes important and avoids jamming of the packaging line or multilation of the resulting package.

To obtain the desired turning of the tubular section, the auxiliary drive means 58 includes a pair of sprocket wheels 60, 61 which are keyed to the corresponding ends of shaft 51 and tubular member 55, respectively. The wheels may be connected to one another by an endless chain 62. It is desirable to conceal the sprocket wheels and chain in an elongated casing 63 which moves as a unit with one of the arms 54.

As seen in FIG. 1, tubular section 55 is provided with a plurality of hose nipples **55*a* which are arranged in axially spaced relation. A piece of flexible hose 64 is connected at one end to a selected one of the nipples 55*a*** and at the other end to a vacuum source V.

As seen in FIGS. 1, 3, and 4, the pivotal movement of the transfer section T between modes Y and Z is effected by a rack R which meshes with the periphery of drive gear 53, the latter being keyed to the one end of shaft 51. One end of rack R is attached to a suitable drive connection C. A guide wheel W is mounted on an adjacent housing wall and is in rolling contact with the upper surface of rack R and maintains the latter in meshing relation with the gear 53. Other means than shown may be utilized to impart the desired motion to the transfer section.

As aforementioned, the size, shape, and number of openings formed in the adaptor plate may be varied from that shown without departing from the scope of the invention. In addition, the motion of the transfer section and the manner of driving same may also be varied from that heretofore described.

Thus, an improved sheet feed and transfer apparatus has been disclosed which is of simple construction, and is readily capable of handling sheets or the like which vary in size and shape over a wide range. The improved apparatus is easy to service and maintain, and does not subject the sheets to the possibility of permanent distortion or defacement.

I claim:

1. An apparatus for feeding and transferring a top sheet from a stack of sheets arranged in substantially superposed relation, said apparatus comprising a frame; a first means mounted on said frame for controlled movement relative thereto in a substantially vertical direction from a predetermined first position, said first means being adapted to support the stack of sheets; second means operatively connected to said first means and effecting controlled movement thereof; a third means fixedly mounted on said frame and disposed at a predetermined elevation relative to said first means when the latter is at said first position, said third means being provided with an opening having a predetermined configuration and in registration with the top sheet of the stack upon said first means being moved upwardly from said first position, said opening having opposed first perimetric segments provided with upwardly convergent surfaces for frictionally engaging peripheral portions of the top sheet and causing upward distortion of the latter, the upward force exerted on the stack by said first means being such that the top sheet will remain in frictional engagement with said convergent surfaces; fourth means positioned adjacent second perimetric segments of said third means opening for circulating air across the underside of the distorted top sheet and effecting partial separation thereof from the adjacent sheet in the stack; and fifth means disposed above said third means and movable towards and away from the opening thereof for engaging the distorted top sheet and drawing same completely through the opening while the adjacent sheets of the stack remain in frictional engagement with the convergent surfaces.

2. The apparatus of claim 1 wherein the second means for effecting controlled movement of said first means includes a source of pneumatic pressure; a piston-cylinder assembly having the piston thereof connected to said first means, the cylinder of said assembly being fixedly mounted and in communication with the source of pneumatic pressure.

3. The apparatus of claim 2 wherein the source of pneumatic pressure includes a manifold means in communication with said air-circulating fourth means.

4. The apparatus of claim 3 wherein the manifold means is fixedly mounted at a predetermined distance beneath said third means and includes a plurality of guide elements slidably engaged by said second means.

5. The apparatus of claim 4 wherein the manifold means includes fixedly mounted upright spacer elements; said third means being removably secured to said spacer elements.

6. The apparatus of claim 5 wherein the manifold means has the cylinder of the piston-cylinder assembly fixedly mounted thereon.

7. The apparatus of claim 1 wherein the first means includes a plurality of vertically adjustable pusher plates arranged in side-by-side relation, each pusher plate subtending and supporting a stack of sheets and the third means includes an adaptor plate provided with a plurality of openings, each opening being aligned with a stack supported by a pusher plate.

8. The apparatus of claim 7 wherein each pusher plate is movable independently of the other in a vertical direction.

9. The apparatus of claim 8 wherein each pusher plate is provided with a piston-cylinder assembly and the piston thereof is connected to a corresponding pusher plate and the cylinder thereof is fixedly mounted; the upward pressure exerted by each piston being adjustable to a predetermined amount.

10. The apparatus of claim 1 wherein the fourth means includes a plurality of air nozzles arranged adjacent to the second perimetric segments of the third means opening, said nozzles directing air flow in a substantially horizontal direction across said opening.

11. The apparatus of claim 1 wherein the fifth means includes a suction unit for engaging a surface portion of the distorted top sheet disposed within the opening in said third member when said fifth means is disposed at one terminus of its movement.

12. The apparatus of claim 8 wherein the fifth means includes an elongated first shaft mounted laterally of said third means opening for controlled movement about its longitudinal axis; and an elongated second shaft connected to said first shaft and mounted in spaced substantially parallel relation with respect to said first shaft and movable therewith as a unit, said second shaft supporting said suction unit.

13. The apparatus of claim 12 wherein said first shaft is provided with a first drive means for effecting controlled movement of said first and second shafts through a predetermined sector; said second shaft being provided with a second drive means operatively connected to said first drive means for effecting independent controlled turning of said second shaft about its longitudinal axis as said first and second shafts move as a unit through said predetermined sector.

* * * * *